United States Patent [19]

Tinnes et al.

[11] Patent Number: 4,730,660

[45] Date of Patent: Mar. 15, 1988

[54] PROCESS FOR CASTING MOLTEN METAL INTO SEVERAL STRANDS

[75] Inventors: Bernhard Tinnes, Zollikerberg, Switzerland; Heinz Kreuzberg, Bernau, Fed. Rep. of Germany

[73] Assignee: Metacon Aktiengesellschaft, Zurich, Switzerland

[21] Appl. No.: 916,394

[22] Filed: Oct. 7, 1986

Related U.S. Application Data

[63] Continuation-in-part of Ser. No. 772,747, Sep. 4, 1985, abandoned.

[30] Foreign Application Priority Data

Sep. 5, 1984 [DE] Fed. Rep. of Germany ..... 3432611
Oct. 26, 1985 [DE] Fed. Rep. of Germany ..... 3538222

[51] Int. Cl.[4] ..... B22D 11/18; B22D 11/20

[52] U.S. Cl. ..... 164/453; 164/454; 164/483; 164/420

[58] Field of Search ..... 164/453, 454, 449, 450, 164/420, 483, 413

[56] References Cited

FOREIGN PATENT DOCUMENTS 56-68570 6/1981 Japan ..... 164/483
2099189 12/1982 United Kingdom ..... 164/453

OTHER PUBLICATIONS

"Tundish Slidegate valve", I. Depierreux et al., Concast Convention 1984, Closed Pouring Techniques for the Continuous Casting of Billets, Metacon AG, Zurich, Switzerland, pp. 1–24.

"Tundish Slidegates on Multistrand Continuous Casting Machines", Bernhard H. Knell, Special Print, Edition 1984/85, Metacon AG, pp. 83–86.

"Meeting on Continuous Casting", Duisburg/Germany 1984, Bernhard Tinnes, Metacon AG, Automatic Casting with Tundish Slidegate Valves on 6-strand Billet and Bloom Continuous Casting Machines, pp. 1–22.

*Primary Examiner*—Kuang Y. Lin
*Attorney, Agent, or Firm*—Wenderoth, Lind & Ponack

[57] ABSTRACT

The casting of several strands with a common puller unit is effected by a process which allows a high degree of operational reliability in its initial start-up phase. To accomplish this, slide gates or valves are throttled at a predetermined level provided in the lower area of a measuring section monitoring the levels in a group of molds and the strand-pulling drive is switched on and the slide gates of molds that have remained in the level below the level are closed no later than at a point when at least one of the actual levels in the molds is at another predetermined level which is below the optimum level. The rising of the levels in the molds may be controlled in accordance with preset rising curves.

6 Claims, 7 Drawing Figures

PROCESS FOR CASTING MOLTEN METAL INTO SEVERAL STRANDS

CROSS-REFERENCE TO RELATED APPLICATIONS

The present application is a continuation-in-part of now abandoned application Ser. No. 772,747, filed Sept. 4, 1985, now abandoned.

BACKGROUND OF THE INVENTION

The present invention relates to the casting of molten metal, particularly molten steel, from a tundish into a plurality of continuous casting molds by means of controllable spout closures, the filling level in the molds being maintained at a desired level within a measuring section and the developing strands being pulled at a steady rate by a common puller unit.

Such a process is known and described in European Pat. No. EP 0 019 114, which, in order to facilitate the start of casting, proposes in column 4, at the bottom, that a very great height range be provided for the bath or filling-level measuring devices of the molds so as to allow the system to be able to compare the climb rates of the levels in the molds with one another. In this process, the purpose of the comparison is to detect different rates of inflow early on and to activate electromagnetic regulating means serving as spout closures or operating with gas tuyeres before the desired level is reached in order to enable a trouble-free start of casting. However, no information of any kind is provided about such a procedure.

The problem underlying the present invention is seen in improving the casting of the strands in the initial phase, performed at a constant withdrawal rate, with simple process steps aimed especially at furthering the reliability of the operation.

SUMMARY OF THE INVENTION

According to the present invention, the abovenoted problem is solved in that at the start of casting at the tundish—with spout closures open—the actual level, which rises in each mold above the dummy bar heads, brings about the generation of a signal which is provided when the actual level is at a predetermined level in the lower area of the measuring section, i.e.—the section in which the metal level is being measured, the thus generated signal causing the throttling of its spout closure in order to equalize all of the actual metal levels and, thereafter, the strand-pulling drive, which, if no equalizing ensues, is turned on no later than at a point at which the first of the actual levels of the molds reach a second level which is below the desired level. In this way, the actual metal levels of all of the molds are brought to a proper level early on, enabling the strand-pulling drive to be turned on and ensuring the trouble-free transition to the desired level especially when the spout closures of those molds—whose levels, after the strand-pulling drive has been turned on, still lie below the throttle signal level—are closed automatically. Thus, molten metal is prevented from flowing out of a mold which still has not formed an adequate strand skin and which would render inoperable system components, e.g., the secondary cooling located therebelow, thereby preventing the withdrawal of the intact strands.

To carry out this process, a system has proved to be extremely useful in which, within the level-measuring section, electronic units are used to control the desired level so as to be at a level which is 85 percent of the height of a measuring section, the measuring section being that part of the mold in which the metal level is being measured. When the actual level is at least 10 percent of the height of the measuring section, spout closures are effected and the strand-pulling drive energized and, when the actual level reaches 70 percent of the height of said measuring section, the strand-pulling drive is started and the remaining valves, whose molds are inadequately filled, are closed. With this design, the measuring-section percentages represent data concerning areas that can be adapted to operating conditions prevailing at any given time without modifying their profile.

An additional embodiment of the present invention is a further development of a casting method wherein the valves are controlled when the actual metal levels are within a filling level measuring section of the ingot molds such that the metal is pulled at a constant removal speed. The basic object of this additional embodiment is to essentially improve the start-up procedure of the casting with simplified method steps which in turn results in a higher production yield.

This additional embodiment of the present invention effects this object as follows: The strand-puller drive is started after the actual filling levels of all of the ingot molds has reached their predetermined lower levels, or at such time that the first actual filling level has reached an upper predetermined level, and each actual filling level is controlled from its lower level along a preset rising curve to its nominal filling level. In this manner, the equalization of the actual filling levels of all of the ingot molds striven for by the first embodiment of the present invention can be circumvented with advantage and the actual filling level of each ingot mold can be introduced smoothly into the normal inflow control of the nominal filling level in a separate way with an advantageous starting of the strand-puller drive at a filling level of the ingot molds between the lower and the upper predetermined levels of the measuring sections which assures a safe removal of the strands. Accordingly, the strand-puller drive reacts to that which occurs first while the actual filling levels are rising in the ingot molds. It starts either when the lower predetermined level is passed by the last actual filling level or, if this does not occur, as soon as the first actual filling level has reached the upper level. As in the first embodiment, after the strand-puller drive has been started, the spout closures of those ingot molds whose actual filling level is still below the lower predetermined level close automatically.

For an especially smooth and yet operationally safe casting operation, the present invention teaches that the control of the spout closures which starts at the lower predetermined level be allowed to occur along a rising curve in an area over the freezing limit of the molten metal in the mold on the one hand and below the spill limit of the molten metal over the edge of the ingot mold during the transition to the control of the nominal filling level on the other hand. In such a procedure, the transition from the control along the rising curve defined by rapid changes in the crosssection of flow at the spout closures to the relatively slow control of the nominal filling level occurs with an ingot bath level which remains relatively calm, and also, freezings which occur in the spout closures and hinder the casting stream are largely counteracted. The latter situation is also aided if the casting is performed with spout closures throttled up to 50 percent, whereby it is advantageous if the spout closures which are the furthest removed from the filling point of the tundish or which belong to the outer ingot molds are throttled less than the inner ingot molds. This effectively takes into account the low temperatures of the molten metal prevailing in the outer areas of a continuous casting plant or of a tundish. There is also the possibility of completely opening the spout closures of those molds whose actual filling levels lag during casting below the lower predetermined level before control along the rising curve in order to rinse away any freezing accumulations.

BRIEF DESCRIPTION OF THE DRAWINGS

The invention will now be described with reference to the accompanying drawings in which.

DESCRIPTION OF THE PREFERRED EMBODIMENT

Figure 1:
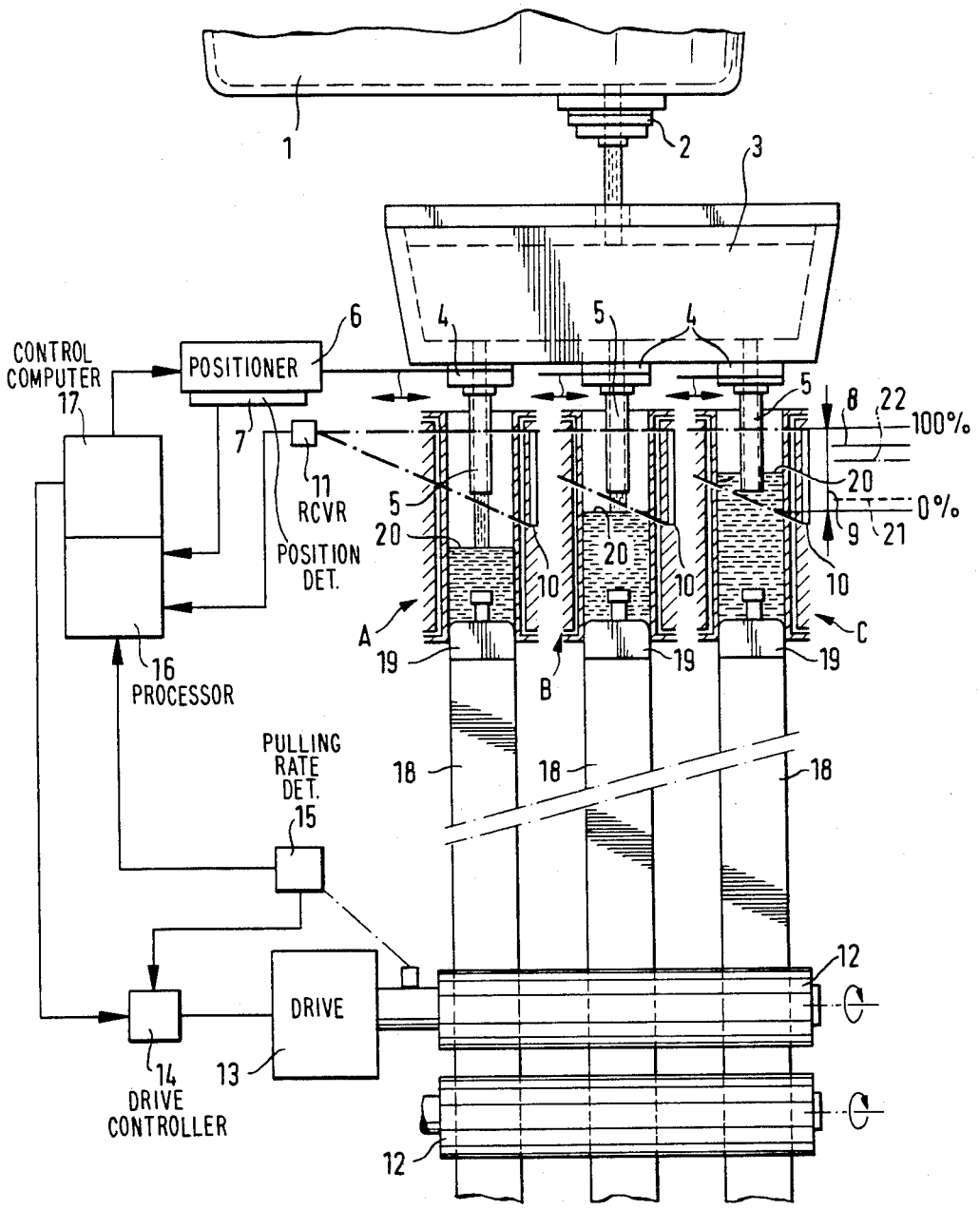
FIG. 1 is a schematic diagram of a multi-strand casting system at the start of casting.

Now, referring to FIG. 1, reference numeral 1 denotes a pouring ladle from which molten steel is supplied via a controllable spout closure 2 to a tundish 3, which, in turn, has three spout closures in the form of slide gates or valves 4 which regulate the inflow of the molten metal through casting tubes 5 into continuous casting molds A, B, C. To this end, each slide valve is mechanically coupled to a positioner 6, whose particular operating position is detected by a position detector 7. The free ends of casting tubes 5 extend into the molds A, B, C, whose desired level 8, set for normal operation, lies, for example, at a level which is 85 percent of the height of the measuring section 9 of a level-measuring device assigned to each of th molds A, B, C. Each device comprises a transmitter 10 and a receiver 11.

Molds A, B, C are followed by a secondary cooling system not shown for the sake of simplicity and by a puller unit shared by the strands 18 and having driving rolls 12, a drive 13, a drive controller 14 and a pulling-rate detector 15. The detector 15 transmits its data to both the drive controller 13 and to a processor 16, which also receives and processes the data from each of the positioners 7 that monitor the degree of opening of their respective slide valves 4, and the data from each of the receivers 11 of the level-measuring devices 10 and 11. The data so obtained are transmitted to a control computer 17 integrated with the processor 16. The computer 17 transmits the corresponding control commands to the positioner 6 of each of the slide valves 4 and to the drive controller 14 of the strand-pulling drive 12–15. There, the pulling rate is set as a constant, i.e., the strands 18 formed into the molds A, B, C are pulled at a constant speed by the common puller unit 12–15, which is to say that the desired level 8 provided for the molds is regulated only form the supply side by means of the slide valves 4. To this end, the slide valves 4 are held in throttling positions during the normal casting operation so as to enable them to cover the uncovered ports.

For the start of casting, the cold strands 18 are moved into the molds A, B, C and the strand-pulling drive 13 is switched off. The casting begins with the bringing into position of the slide valves 4, which, depending on the formats of the strands to be cast, are opened fully or only partially, so that there are formed above the dummy bar heads 19 in the molds A, B, C actual levels 20 which, however, are seldom even.

In particular, different conduit cross-sections arise and, accordingly, different rates of outflow per unit of time of metal flowing from the casting tubes 5 occur, because narrowings appear in the discharge or flow conduits of the tundish 3 and of the slide valves 4, e.g., due to the formation of anomalies resulting from the freezing of molten metal in areas of the conduit wall that have not yet been heated sufficiently. Likewise, the viscosity is increased by cooling down the molten steel over a fairly long length of run in the tundish.

Equalization, sometimes, of very different actual levels 20 is effected by throttling each slide valve 4 in the corresponding mold A, B, C when its actual level reached a level 21 located at a height of preferably 10 percent of the measuring section 9. The actual levels 20 of all of the molds A, B, and C are monitored and at the completion of the filling of the molds to a desired level, the control computer 17 turns on the strand-pulling drive 13. The desired level 8 is then stabilized in the customary manner. If level equalization does not ensue or if it occurs only between two of the three molds A, B, C, then the control command for turning on the strand-pulling drive 13 is given no later than at the point at which the first level 20 of the molds reaches another level 22 which is below the desired level 8. At the same time, closing commands are received by those slide valves 4 in whose molds A, B, or C the actual levels 20 still lie below the level 21.

Figure 2:
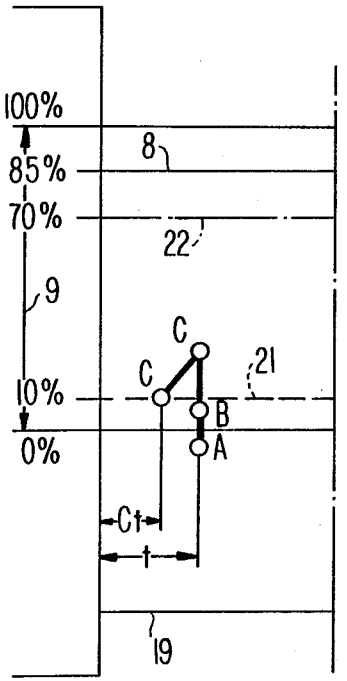
FIGS. 2–5 show in a diagram various programs that can be run during the start of casting in accordance with one embodiment of the present invention.

The graph in FIG. 2 applies to the actual levels 20 illustrated in FIG. 1, according to which the actual level 20 of the mold C was the first to exceed the level 21 after the simultaneous complete opening of all the slide valves 4 at the start of casting in the time Ct, the slide valve 4 corresponding to the mold C being moved to the throttling position. From this instant on, the levels 20 in the molds A and B rise faster than the level in the molds C up to the instantaneous configuration shown in FIG. 1, which was attained at the end of the casting time t.

In the following FIGS. 3–5, the casting time t is plotted until the desired level 8 levels out.

Figure 3:
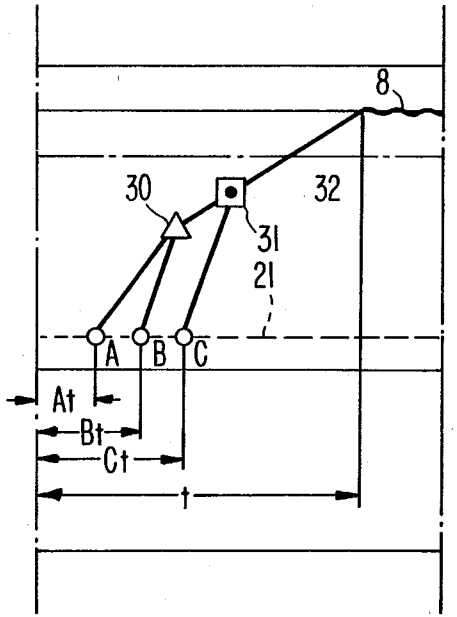

Thus, it is apparent from FIG. 3 that the signal level 21 was first exceeded by the actual level of the mold A in the time At, then by the actual level of the mold B in the time Bt and, finally, by the actual level of the mold C in the time Ct, during which the slide valves 4 were throttled in the proper sequence. After the closures A4 and B4 (i.e.—slide valves 4 of molds A and B) have been throttled, there is obtained at point 30 the same level for the two actual levels A20 and B20 (i.e.—levels 20 of molds A and B), even before the throttling of the slide valve 4 of the mold C, whose actual level 20 occurs at point 31 with respect to the actual levels A20 and B20, at which point the strand-pulling drive 13 is turned on, preferably at 70 percent of the nominal rate. As soon as the withdrawal drive is running, there arises a curve 32 which presents identical actual levels and which is clearly flattened. This means that the actual levels rise more slowly until, at the end of the casting time t, the adjustment into the desired level 8 is completed.

Figure 4:
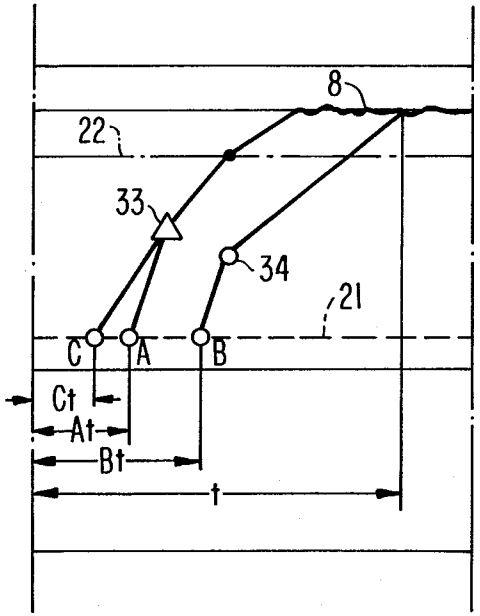

In the embodiment depicted in FIG. 4, the actual level B20 does not reach a common level with the actual levels A20 and C20, although all the actual levels at the times Ct, At and Bt have exceeded the throttle signal level 21 and the levelling-out of the actual levels C20 and A20 has occurred at point 33. As the rise in the levels continue, the two equal actual levels C20 and A20 reach the second level 22, at which time the strand-pulling drive 13 is switched on, and finally pass into the desired level 8 where the actual level B20 arrives, after passing through the point 34 in its rise, at the end of the casting time t.

Figure 5:
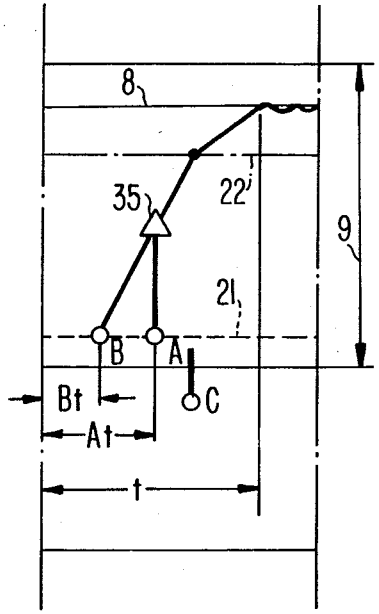

The start of casting shown in FIG. 5 indicates a similar course. Here, the actual levels B20 and A20 rise together from point 35 on to the level 22 after the throttling of the slide valves B4 and A4 at the level 21 in the times Bt and At, then rise to the desired level 8 in the time t. By contrast, when the strand-pulling drive 13 is switched on by the actual levels B20 and A20, the actual level C20 has not exceeded the critical level 21, but has remained even below the 0 percent start of the measuring section 9, triggering an automatic closing of the gate valve C4.

With such monitoring, continuous casting plants with a common puller unit for multiple strands can be brought to the desired metal level height with a high degree of operational reliability.

Presented below is a description of another embodiment of the present invention.

As in the first embodiment, in FIG. 1, reference numeral 1 designates a pouring ladle from which molten steel is supplied via controllable spout closure 2 to a tundish 3 which has three spout closures in the form of slide gates or valves 4 which control the inflow of the molten metal via casting tubes 5 into continuous casting ingot molds A,B,C. To this end, each slide gate is mechanically coupled to a positioner 6 whose particular operating position is detected by a position detector 7. Casting tubes 5 extend with their free ends into ingot molds A,B,C, whose desired filling level 8, set for normal operation, is located within measuring section 9 of a level-measuring device consisting of transmitter 10 and receiver 11 and associated with each ingot mold A,B,C. Ingot molds A,B,C are followed by a secondary cooling system, not shown for the sake of simplicity, as well as by a puller unit which is common to the strands 18 and which comprises drive rollers 12, drive 13, drive controller 14 and pulling rate detector 15. The latter feeds its measured values to the drive controller 14 and to processor 16 which also receives and processes the measured values of position detector 7 and of the receiver 11 of the level measuring devices 10 and 11 and which controls the degree of opening of the slide gates 4. The received data goes to the control computer 17 which is inegrated with the processor 16, and which outputs appropriate control commands to the positioner 6 of slide gates 4 and to drive controller 14 so as to control the driving rolls 12 which are driven by the drive 14. There, the removal speed is set as a constant, i.e. strands 18 formed in ingot molds A,B,C, are removed by the common puller unit 12 to 15 at a steady speed, which is to say that the desired filling level 8 is provided for the ingot molds is controlled solely from the inflow side by means of the slide gates. To this end, slide gates 4 are held during a normal casting operation at the desired filling level in a throttled position in order to make it possible to regulate the levels both up and down.

For casting, for which strands 18 are run into ingot molds A,B,C and the puller drive 13 is cut off, the measuring section 9 is provided with a lower level 21 and upper level 22 which regulate slide gates 4 and the puller drive 13. However, this occurs differently than the first embodiment, because during the casting, the actual filling levels 20 of all of the ingot molds A,B,C are to be brought to one level between levels 21 and 22.

In particular, according to the casting in accordance with this embodiment of the present invention, the slide gates 4 are first opened preferably only 35 percent, but not completely in any case. This creates control reserves for gates 4 both in the direction of closing and of opening which permit every actual filling level 20 rising in ingot mods A,B,C (see FIG. 6) to rise from lower level 21 to desired filling level 8 along set rise curve 40, which is adapted to the operating conditions of the particular plant by an appropriate programming of the processor 16.

The criterion of curve 40, which determines the filling speed of ingot molds A,B,C during casting, is to never be so flat or so steep that it drops below the freezing limit of the molten metal in the slide gates or exceeds the upper spill limit on the edge of the ingot mold. The control of each slide gate 4 according to curve 40 starts, as stated, at the lower level 21 and is triggered by filling level 20 rising in the corresponding ingot mold A,B,C. If the last of all actual filling levels A20 or B20 or C20 exceeds lower level 21 during rising, the control computer 17 associated with processor 16 starts the puller drive 13 of the common puller unit for strands 18. Thereafter, the rise of the actual filling levels A20, B20, C20 is completed independently of each other on the basis of the same criteria and consequently of parallel rise curves 40 until building up to the desired filling level 8 set for normal casting operation. If the buildup were to receive excessive impulses due to a too rapid rising of filling level 20, there would be a spill over the edge of the input mold. If an actual filling level 20 of ingot mold A,B or C reaches the upper level 22 during casting while others are still below the lower level 21, closing commands result for the slide gates 4 of actual filling levels 20 which remain behind in the manner mentioned above.

Figure 6:
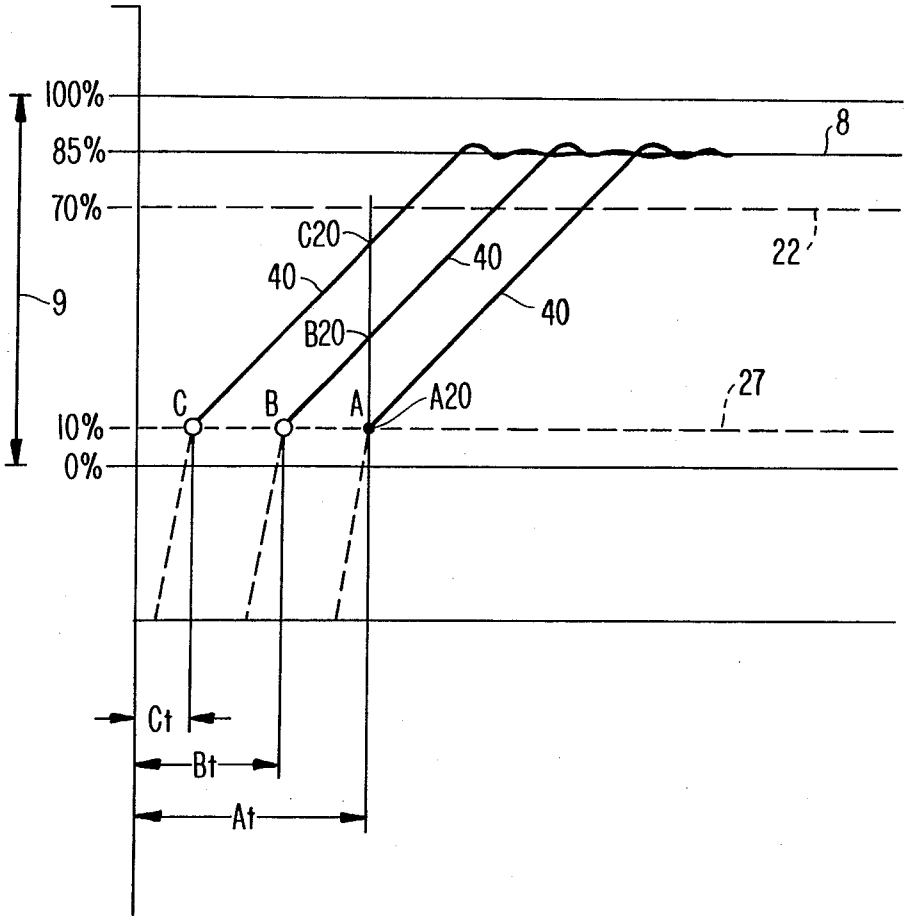

The graph of FIG. 6 applies to the actual filling levels 20 shown in FIG. 1. According to this graph, the actual filling level 20 of ingot mold C was the first to reach the lower level 21 in time Ct after a simultaneous throttled opening of all slide gates 4 at the start of casting, whereby slide gate 4 associated with ingot mold C assumes the control of the feed of the molten metal according to described rise curve 40. As a result, the actual filling levels 20 of ingot molds B and A pass the level 21 one after the other at times Bt and At, where they effect the rise control in accordance with curve 40. None of the actual filling levels 20 has remained back to any appreciable degree. A20 reaches the lower level 21 before C20 reaches the upper level 22, so that the start command for strand puller drive 13 is due to the raising of the actual filling level A20.

Figure 7:
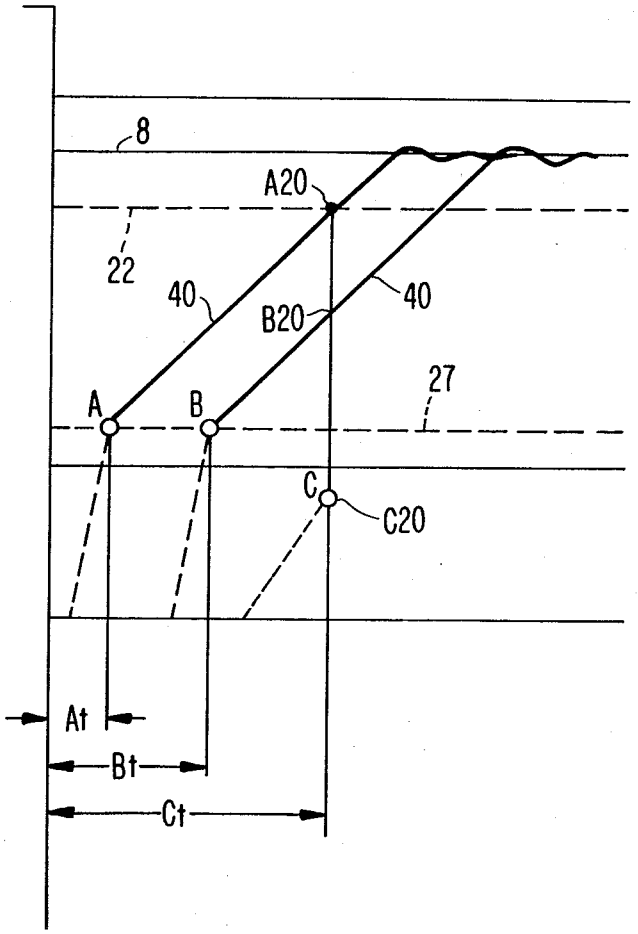
FIGS. 6 and 7 show in a diagram various programs that can be run during the start of casting in accordance with another embodiment of the present invention.

The situation is different in the example of FIG. 7, in which actual filling level A20 has reached the upper level 22 and the actual filling level B20 has passed the lower level 21, but the actual filling level C20 is lagging below this level. In this configuration of the actual filling levels, the strand puller drive 13 is started at the time that the upper level 22 is reached by the actual filling level A20 and at the same time, the slide gate 4 is closed due to the fact that the actual filling level C20 has not risen over lower level 21.

We claim:

1. A process for casting molten metals from a tundish into a plurality of continuous casting molds by means of a plurality of controllable valves, each of the molds having a corresponding valve and a measuring section within which the level of the metal is measured, the filling level in each of the molds being maintained at a desired level with respect to the measuring section corresponding thereto and the developing strands emanating from said molds being pulled by a common strand puller drive unit at a steady rate, the process comprising the steps of:

opening all of the valves at the start of a casting operation;

allowing the actual metal level in each of the molds to rise above corresponding dummy bar heads contained therein until such time that the actual metal level reaches a first predetermined level in the lower area of its corresponding measuring section and then throttling the corresponding valve in each of the molds so as to equalize the actual metal levels in all of the molds; and turning on the strand puller drive unit; or, alternatively, if no level equalization of the actual metal level in all of the molds occurs, turning on the strand puller drive unit at such time that at least one of the actual metal levels in the molds reaches a second predetermined level which is below the desired level in the molds.

2. A process as recited in claim 1, further comprising the step of closing the valves of those molds whose actual metal level still lies below the first predetermined level after the step of turning on the strand puller drive unit.

3. A process as recited in claim 1, wherein the first predetermined level is equal to 10 percent of a maximum mold metal level and the second predetermined level is equal to 70 percent of the maximum mold metal level and the desired level is equal to 85 percent of the maximum mold metal level.

4. A process as recited in claim 1, wherein after the step of opening all of the valves, the filling levels of each of the mold is controlled along a preset rising curve from the point of time in which the actual metal level reaches the first predetermined level until such time that it reaches its desired level.

5. A process as recited in claim 2, wherein after the step of opening all of the valves, the filling levels of each of the molds is controlled along a preset rising curve from the point of time in which the actual metal level reaches the first predetermined level until such time that it reaches its desired level.

6. A process as recited in claim 3, wherein after the step of opening all of the valves, the filling levels of each of the molds is controlled along a preset rising curve from the point of time in which the actual metal level reaches the first predetermined level until such time that it reaches its desired level.

* * * * *